United States Patent [19]

Angst

[11] 4,121,781

[45] Oct. 24, 1978

[54] YARN TENSION COMPENSATING APPARATUS

[75] Inventor: Kurt Angst, Wängi, Switzerland

[73] Assignee: Rieter Machine Works Ltd., Winterthur, Sweden

[21] Appl. No.: 876,631

[22] Filed: Feb. 10, 1978

[51] Int. Cl.[2] ..... B65H 59/10

[52] U.S. Cl. ..... 242/45; 242/18 R; 242/18 DD; 242/147 R

[58] Field of Search ..... 242/45, 43 R, 18 R, 242/18 DD, 147 R

[56] References Cited

U.S. PATENT DOCUMENTS

| | | | |
|---|---|---|---|
| 770,179 | 9/1904 | Legg | 242/45 X |
| 1,019,839 | 3/1912 | Rigby | 242/45 |
| 1,647,198 | 11/1927 | Sands | 242/45 |
| 2,236,459 | 3/1941 | Swanson | 242/45 |
| 2,426,473 | 8/1947 | Straw | 242/147 R X |
| 2,992,792 | 7/1961 | van der Hoek | 242/45 X |
| 3,188,713 | 6/1965 | Dyer et al. | 242/147 R X |
| 3,498,553 | 3/1970 | Lee | 242/45 |
| 3,578,795 | 5/1971 | Polese | 242/45 |

*Primary Examiner*—Stanley N. Gilreath
*Attorney, Agent, or Firm*—Werner W. Kleeman

[57] ABSTRACT

A yarn tension compensating apparatus for a winding device of a textile machine, such as winding or spooling machine, arranged between a take-off roll and a take-up bobbin having operatively associated with the take-up bobbin a yarn traversing device. A deflecting roll is connected with lever means for compensating the variations in the yarn tension generated during the yarn traversing movement. The lever means embodies an intermediate section comprising a flat spring embedded in two resilient elements, specifically rubber-elastic or elastomeric elements. The lever means further comprises a roll support at which there is clamped one end of the spring and a support adapted to be mounted on the frame of the textile machine at which there is clamped the other end of such spring.

11 Claims, 1 Drawing Figure

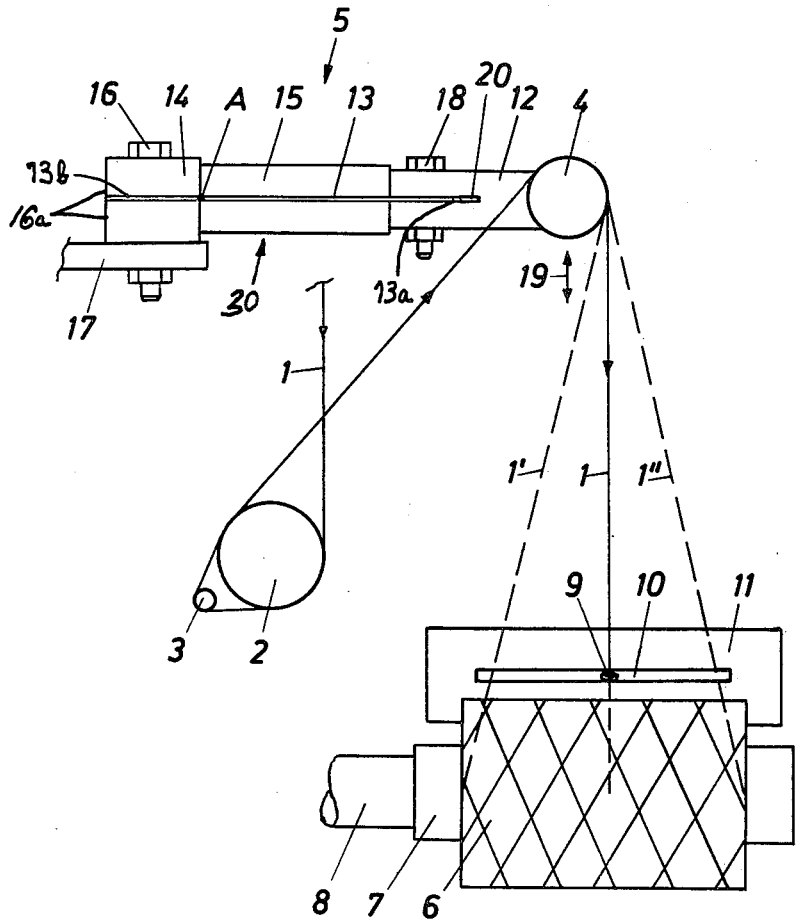
5
16
14
A
15
13
18
20
12
4
13b
16a
17
30
13a
19
1
1'
1
1''
9
10
11
3
2
8
7
6

YARN TENSION COMPENSATING APPARATUS

BACKGROUND OF THE INVENTION

The present invention relates to a new and improved construction of a yarn or thread tension compensating apparatus for a winding device of a textile machine, typically a winding or spooling machine, which is arranged between a take-off roll and a take-up bobbin having operatively associated therewith a yarn traversing device.

In the context of this disclosure the term "yarn" as used herein is employed in its broader sense as encompassing not only yarns, but threads and other filamentary material of the type normally processed at a textile machine, especially a winding or spooling machine.

The yarn tension compensating apparatus of the invention is generally of the type which is provided with a deflecting roll connected with a lever or lever means for compensating variations in the tension of the yarn which are produced by the yarn traversing or reciprocating motion.

During the winding process at winding machines the yarn is conventionally traversed to-and-fro. During such traversing movement there automatically occurs a periodic variation in the length of the yarn path through which the yarn travels. This is so since the distance between the take-off roll, or, the last guide roll, as the case may be, respectively, and the lateral end of the bobbin package is greater than the distance to the center of the bobbin package. This length variation and the yarn tension variations produced as a result thereof, usually are compensated by guiding the yarn over a yarn tension compensating device arranged between the take-off roll and the bobbin package. State-of-the-art yarn tension compensating devices comprise a deflecting roll connected to a pivoting arm. This deflecting roll can be freely moved along the pivoting path. Depending upon the momentary yarn tension, i.e., depending upon the momentary position of the yarn traversing device, the deflecting roll is pivoted to a greater or lesser extent out of its idling position towards which it tends to move under the action of a restoring force exerted, for instance, by a counterweight or a spring. Such prior art yarn tension compensating devices are associated with the drawback that at high winding speeds, and thus, necessarily at high yarn traversing frequency of the yarn traversing device, the deflecting roll tends to uncontrollably vibrate under the influence of inertia forces.

A proposal for alleviating this drawback has become known to the art from Japanese Utility Model Publication No. 47-19552 which teaches a yarn tension compensating device using a pivotable double-arm lever which is pivotably mounted about a pivot point which is spatially fixed. At one lever arm of the pivotable double-arm lever there is carried the deflecting roll and at the other lever arm there is supported a counterweight. At the side carrying the counterweight the lever arm additionally is attached to two springs situated opposite one another and fixed to the machine frame. In this way, each deviation of the deflecting roll is dampened by the correspondingly counteracting spring. Nonetheless at high wind-up speeds the deflecting roll still uncontrollably vibrates.

SUMMARY OF THE INVENTION

Hence, with the foregoing in mind, it is a primary object of the present invention to provide a new and improved construction of yarn tension compensating apparatus which is not associated with the aforementioned drawbacks and limitations of the prior art proposals.

Another and more specific object of the present invention aims at the provision of a yarn tension compensating apparatus wherein the deflecting roll reliably compensates for periodic variations in the length of the yarn path of travel and the yarn tension, even when working with presently conventional high winding speeds and without the deflecting roll uncontrollably vibrating.

Still a further significant object of the present invention aims at a new and improved construction of yarn tension compensating apparatus which is relatively simple in design, economical to manufacture, extremely reliable in operation, not readily subject to breakdown or malfunction, and requires a minimum of maintenance and servicing.

Now in order to implement these and still further objects of the invention, which will become more readily apparent as the description proceeds, the yarn tension compensating apparatus of the present development is manifested by the features that the lever means has a middle or intermediate section comprising a flat spring embedded in two rubber-elastic or elastomeric elements. The lever means includes a roll support at which there is clamped one end of the spring and a support adapted to be mounted onto a frame of the apparatus at which there is clamped the other end of such spring.

The resilient elements, namely the rubber-elastic or elastomeric elements can be preferably connected so as to adhere with the flat spring. It can be advantageous to fabricate the flat spring from spring steel and the rubber-elastic elements of polymerized chloroprenes. A further advantage can be achieved if the flat spring is clamped in such a manner that the rubber-elastic elements, even in the idle state of the yarn tension compensating apparatus, are compressed in the longitudinal direction of the lever means.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE of the drawing shows schematically a yarn tension compensating apparatus constructed according to the teachings of the present invention.

DETAILED DESCRIPTION OF THE PREFERRED EMBODIMENTS

Describing now the drawing, there is shown by way of example a textile machine, here a winding or spooling device of a draw-winding machine equipped with a yarn tension compensating apparatus according to the invention. Obviously, the yarn tension compensating apparatus can be also employed with other types of textile machines as will be readily evident to those skilled in the art. Equally, for the purpose of preserving clarity in illustration, only enough of the draw-winding machine has been shown to enable those versed in this particular field of technology to readily understand the underlying principles and concepts of the invention.

Turning particularly now to the drawing, there will be seen that a yarn or thread 1 or other filamentary material processed by the textile machine, is guided by means of a draw-roll 2 equipped with a standard separator roll 3 of a drawing device not here shown in greater detail, through the intermediary of a deflecting or deflection roll 4 of a lever-shaped yarn tension compensating apparatus, generally indicated by reference character 5, before it is wound into a bobbin package 6. The draw-roll and the separator roll 3 constitute take-off rolls, whereas the bobbin tube 7 at which there is wound the bobbin package 6 constitutes the take-up bobbin. As evident to those initiated in this technology, the bobbin package 6 is built-up on the bobbin tube 7 which, in turn, is supported on a rotatable shaft 8. As is also conventional and therefore not particularly illustrated, a standard friction drive drum drives the bobbin package 6. Before the yarn 1 is wound onto the package 6 it is traversed to-and-fro in standard fashion by any suitable yarn traversing guide 9 in a slot 10 of a yarn traversing device 11. Further details of the textile machine are unnecessary for understanding a possible contemplated environment of use of the inventive yarn tension compensating apparatus 5 to which the aspects of the present development are related.

Thus, as to such lever-shaped or arm-like yarn tension compensating apparatus 5, the same comprises a lever arrangement or lever means, generally designated by reference character 30, and also can be construed as an arm arrangement. In any event, the lever means 30 embodies a roll support 12 which rotatably supports the deflection or deflecting roll 4. The one end 13*a* of a flat or blade-like spring 13, advantageously formed of spring steel, by way of example, is arranged so as to extend into a slot 20 provided at the roll support 12. Fixation of such spring end 13*a* at the roll support 12 can be accomplished in any appropriate manner, and here the same is screw connected and clamped at the roll support 12 by means of a screw 18 or other suitable fastening device. The other end 13*b* of the flat spring 13 is affixed, as for instance again by a screw connection by means of a screw 16 or equivalent structure, at a support member 14 of the lever or arm means 30. This support member 14 consists of two blocks 16*a*, for instance steel blocks, and the spring end 13*b* is clamped by the action of the screw 16 between these two steel blocks 16*a*. Screw 16 additionally is used for mounting the lever-shaped yarn tension compensating apparatus 5 onto a plate 17 of the machine frame not otherwise here shown in detail as the structure thereof is totally unimportant for understanding the invention. Now between the support member 14 and the roll support 12 there are adheringly connected, for instance adhesively bonded, two halves of a resilient, namely rubber-elastic or elastomeric element 15 to the flat spring 13. The terms "resilient element" or "rubber-elastic element" or "elastomeric element", whether used in the singular or plural, are intended to means two such type elements or one such element in the form of two halves.

During the winding process, the distance of the yarn path between the deflection roll 4 and the winding point on the bobbin package 6 periodically changes, as schematically indicated in the drawing by the yarn paths 1, 1', 1''. These length variations and the resultant yarn tension variations produced thereby, are now beneficially compensated by means of the yarn tension compensating apparatus 5. This is done inasmuch as the deflecting roll 4 thereof is periodically moved up and down about the axis of rotation A, as generally indicated by the double-headed arrow 19. During movement of the yarn from position 1' to 1'', the deflecting roll 4 together with the roll support 12 is raised and lowered out of the horizontal position of the lever means 30 between a position which is deflected less intensely and a position deflected more intensely downwardly with regard to such horizontal position. During these movements, the resilient elements 15, i.e., the rubber-elastic or elastomeric elements 15, exert a dampening action opposing the movement of the deflecting roll 4.

It has been found that the described yarn tension compensating apparatus 5 functions extremely reliably and periodically compensates the variations in the yarn tension without there occurring any uncontrolled vibrations of the deflecting roll 4. If the flat spring 13 is clamped in such a manner that the rubber-elastic elements 15, already in the idle state of the yarn tension compensating apparatus 5, are compressed to a certain degree between the support member 14 and the roll support 12, then there can be realized a particularly good dampening action of the rubber-elastic elements 15. The rubber-elastic elements 15, counteracting the movement of the deflecting roll 4, preferably are fabricated from polymerized chlorprenes, but however it is to be understood that there can be used a body formed of any other rubber-elastic or elastomeric material as the rubber-elastic elements. In the exemplary embodiment under discussion, the flat spring 13, the support or support member 14, the rubber-elastic elements 15 and the pivotable arm or roll support 12 have the same width, and, with the exception of the flat spring, also possess approximately the same height. Also, instead of adhesively bonding the two parts or halves of the rubber-elastic element 15 to the flat spring 13, these two parts also could be vulcanized onto the flat spring.

The field of application of the inventive yarn tension compensating apparatus is in no way intended to be limited solely to a draw-winding machine, shown herein by way of example, and it is to be expressly understood that such inventive apparatus can be employed on the winding or spooling unit of any desired winding machine. A further advantage of the invention resides in terms of the simple clamping of the flat spring with the therewith connected rubber-elastic elements 15 in the support member 14 and in the roll support 12 which, in turn, enables easy exchange and replacement of the flat spring, so that as a function of the fineness of the yarn which is to be wound, there can be held in storage parts with various thickness of the flat spring. Conversion of the yarn tension compensating apparatus for handling different types of filamentary material or the like can be therefore easily accomplished without any particular difficulties.

While there are shown and described present preferred embodiments of the invention, it is to be distinctly understood that the invention is not limited thereto, but may be otherwise variously embodied and practiced within the scope of the following claims. Accordingly,

What I claim is:

1. A yarn tension compensating apparatus for use with a textile machine, especially a winding device of a winding machine having a yarn take-off roll and a take-up bobbin with which there is operatively associated a yarn traversing device, the yarn tension compensating apparatus being arranged between the take-off roll and the take-up bobbin, comprising, in combination:

lever means equipped with a yarn deflecting roll for compensating variations in the yarn tension generated during the yarn traversing movement;

said lever means comprising:

a flat spring;

two resilient elements between which there is embedded said flat spring at an intermediate section of said lever means;

said flat spring having opposed ends;

a roll support carrying said yarn deflecting roll and at which there is clamped one end of said flat spring; and a support member at which there is clamped the other end of said flat spring.

2. The yarn tension compensating apparatus as defined in claim 1, wherein:

said two resilient elements comprise two rubber-elastic elements.

3. The yarn tension compensating apparatus as defined in claim 1, wherein:

said two resilient elements comprise two elastomeric elements.

4. The yarn tension compensating apparatus as defined in claim 1, wherein:

said support member for the other end of said flat spring is adapted to be mounted onto a frame of the textile machine.

5. The yarn tension compensating apparatus as defined in claim 2, wherein:

said two rubber-elastic elements are adheringly connected with the surface of the flat spring.

6. The yarn tension compensating apparatus as defined in claim 2, wherein:

said flat spring is fabricated of spring steel.

7. The yarn tension compensating apparatus as defined in claim 2, wherein:

said two rubber-elastic elements are fabricated from polymerized chloroprenes.

8. The yarn tension compensating apparatus as defined in claim 5, wherein:

the flat spring is clamped in the support member and in said roll support in a manner such that two said rubber-elastic elements, in an idle state of the yarn tension compensating apparatus, are compressed in the longitudinal direction of the lever means.

9. The yarn tension compensating apparatus as defined in claim 5, wherein:

said two rubber-elastic elements are adhesively bonded to said flat spring.

10. The yarn tension compensating apparatus as defined in claim 5, wherein:

said two rubber-elastic elements are vulcanized onto said flat spring.

11. A yarn tension compensating apparatus for use with a winding device of a textile machine employing mechanism exerting variations in yarn tension on the yarn during winding thereof, said yarn tension compensating apparatus comprising:

means incorporating an arm arrangement provided with a deflecting roll for compensating variations in the tension of the yarn produced during the yarn winding operation;

said arm arrangement having opposed ends and an intermediate portion therebetween;

a flat spring;

rubber-elastic means provided at said intermediate portion of the arm arrangement for embedding therein said flat spring;

said flat spring having opposed ends;

one end of said arm arrangement containing a roll support and the opposite end support means;

means for connecting one end of the spring with said roll support; and means for connecting the other end of said spring with said support means.

* * * * *